US007028600B2

(12) United States Patent
Shrive

(10) Patent No.: US 7,028,600 B2
(45) Date of Patent: Apr. 18, 2006

(54) HYDRAULIC RADIAL PISTON ENGINE

(75) Inventor: Chris Shrive, Dunfermline (GB)

(73) Assignee: Bosch Rexroth AG, Lohr/Main (DE)

( * ) Notice: Subject to any disclaimer, the term of this patent is extended or adjusted under 35 U.S.C. 154(b) by 119 days.

(21) Appl. No.: 10/344,801

(22) PCT Filed: Apr. 28, 2001

(86) PCT No.: PCT/EP01/04803

§ 371 (c)(1),
(2), (4) Date: Jul. 31, 2003

(87) PCT Pub. No.: WO02/16769

PCT Pub. Date: Feb. 28, 2002

(65) Prior Publication Data

US 2004/0040435 A1 Mar. 4, 2004

(30) Foreign Application Priority Data

Aug. 23, 2000 (DE) ..... 100 41 318

(51) Int. Cl.
*F01B 1/00* (2006.01)
*F16J 1/00* (2006.01)

(52) U.S. Cl. ..... 91/491; 92/92; 92/177

(58) Field of Classification Search ..... 91/491, 91/498; 92/72, 177, 172
See application file for complete search history.

(56) References Cited

U.S. PATENT DOCUMENTS

| | | | | |
|---|---|---|---|---|
| 4,486,154 | A * | 12/1984 | Duplat et al. | 417/487 |
| 4,747,339 | A * | 5/1988 | Wusthof et al. | 92/148 |
| 5,179,889 | A | 1/1993 | Wuesthof | |
| 5,746,584 | A * | 5/1998 | Nakamura et al. | 417/273 |

FOREIGN PATENT DOCUMENTS

| | | | |
|---|---|---|---|
| DE | 3531632 | | 3/1987 |
| DE | 4037455 | | 2/1992 |
| DE | 19618793 | | 11/1997 |
| DE | 19618793 | A1 * | 11/1997 |
| EP | 0607069 | | 7/1994 |

* cited by examiner

*Primary Examiner*—Charles G. Freay
(74) *Attorney, Agent, or Firm*—Martin A. Farber

(57) ABSTRACT

A hydraulic radial piston engine has a lifting ring fixed to the casting, a rotor mounted opposite the lifting ring such that it is rotatable about an axis of rotation, multiple piston seats aligned radially in the rotor relative to the axis of rotation, and multiple pistons each displaceably mounted in a piston seat and which, over at least part of their length, have a non-circular guiding and sealing cross section that is coincident with a non-circular guiding and sealing cross section of the piston seats. Circularly cylindrical rollers are borne by the piston. With a given overall size, a greater swept volume per piston is possible and therefore a greater torque is produceable.

9 Claims, 4 Drawing Sheets

HYDRAULIC RADIAL PISTON ENGINE

FIELD AND BACKGROUND OF THE INVENTION

The invention is based on a hydraulic radial piston engine comprising a lifting ring, in particular a multi-stroke lifting ring (15) which is fixed to the casing, a rotor (18) which is mounted opposite the lifting ring (15) such that it can be rotated about an axis of rotation (19) and has multiple piston seats (35) aligned radially with respect to the axis of rotation (19), multiple pistons (50), of which in each case one is displaceably mounted in a piston seat (35) and which, over at least part of its length, has a guide and sealing cross section that differs from a circular shape and matches a guide and sealing cross section of the piston seats (35), which differs from a circular shape and remains constant as far as the outside of the rotor, and cylindrical rollers (58) which are borne by the pistons (50) in bearing seats (56) and are aligned with their axes of rotation (59) in the direction of the axis of rotation of the rotor (18), via which the pistons (50) can be supported on the lifting ring (15) and which have two end faces (60) that face away from each other and run at right angles to their axis of rotation (59).

Such a hydraulic radial piston engine is disclosed by DE 196 18 793 A1. The rotor is located within the lifting ring and has a large number of piston seats that are aligned radially with respect to its axis of rotation and are open outward toward the lifting ring. In each piston seat there is a piston which bears a cylindrical roller in a bearing seat, said roller resting on a lifting cam of the lifting ring. In the case of use as a motor, a working chamber radially on the inside of the piston is connected to a pressure medium source when a roller is located on an outwardly falling flank of the lifting ring, while the working chamber is relieved of pressure when the roller is located on an inwardly rising flank of the lifting ring. As a result, a torque is produced which leads to a relative rotation between rotor and lifting ring. The magnitude of the maximum torque that can be generated depends on the maximum pressure that can be applied to the pistons and the size of the piston area on which the pressure acts. In order to be able to produce a higher torque with a given overall size of a hydraulic radial piston engine, the intention is therefore to have a large cross section of the pistons. However, a piston can have a large cross section only at a relatively great distance from the axis of rotation of the rotor, since otherwise there would be too little rotor material present between the individual piston seats in order to reliably avoid the rotor tearing. Assuming a constant piston cross section over the entire length of the piston, the guide length for the piston would then be too small.

DE 196 18 793 A1 but, for example, also DE 40 37 455 C1 or EP 0 607 069 B1, also discloses obtaining a large effective piston area and a long guide length in hydraulic radial piston engines by the pistons being formed as stepped pistons and the piston seats accordingly being formed as stepped seats. Each piston seat has a first part seat, which is located entirely radially on the outside in the rotor, and a second part seat which is located closer to the axis of rotation than the first part seat and whose cross section is smaller than the cross section of the first part seat. Each piston has a first piston section, which is guided in a sliding manner in the first part seat, and a second piston section which has a smaller cross section than the first piston section and is guided in a sliding manner in the second piston seat. The clearances located radially further in than the first piston section, namely an annular space which is bounded at right angles to the piston axis by the wall of the first part seat and by the second piston section, and axially by the steps on the piston and in the piston seat, and a completely cylindrical space behind the second piston section are connected fluidically openly to each other, so that the effective pressure area is provided by the large cross section of the first piston section. A piston is guided in the first piston section and at the end of the second piston section, so that the guide length is great. The fluidic connection between the annular space and the space behind the second piston section can be produced by means of bores within the second piston section, by means of a longitudinal groove in the second part seat or else, as shown in EP 0 607 069 B1 and DE 196 18 793 A1, by means of flats on the second piston section, parallel to the piston axis or else located conically with respect thereto.

In the case of the radial piston engine disclosed by DE 196 18 793 A1, the first part seat of a piston seat and the first piston section have a guide and sealing cross section differing from the circular shape. This cross section has two long sides running parallel to the axis of rotation of the roller and two semicircles which connect the long sides to each other. As a result of piston seats and pistons having such an elongate cross section in the direction of the axes of rotation of rotor and rollers, it is possible to obtain a large piston area without enlarging the diameter of the rotor and therefore of the overall radial piston engine. However, an enlargement in the axial direction is necessary if the piston area is to be greater than in the case of a circular piston cross section.

The semicircular sections in the cross section additionally entail the rollers being shorter than the piston seat and the pistons in the direction of their axes of rotation, and it is necessary to secure them using rings revolving around the rotor in their axial position.

SUMMARY OF THE INVENTION

The invention is based on the object of developing a hydraulic radial piston engine of the introductory-mentioned type in such a way that, with a given overall size, a greater swept volume per piston is possible and therefore a higher torque can be produced, and that the rollers are secured in their position in the axial direction in a simple way.

In a hydraulic radial piston engine of the introductory-mentioned type, the intended object can be achieved, according to the invention, in that the piston seats have two wall sections aligned at right angles to the axis of rotation of the rollers, and in that the distance between the two end faces of a roller is only slightly smaller than the distance between the two flat wall sections of the piston seats. As a result of the two flat wall sections, even if their distance from each other is not greater than the diameter of a circular piston seat in a rotor of the same size in the radial direction, the piston area to which pressure can be applied is enlarged as compared with a circular piston, without the rotor having to be longer in the axial direction. In addition, the two flat wall sections are used to secure the rollers axially. The rollers are longer than in the case of circular piston seats and circular pistons, with the same extent in the axial direction and in the peripheral direction. Their bearing surface in the piston and their line of contact or surface of contact on the lifting ring can be made correspondingly larger. As a result, the components are loaded less at the same requisite torque or are able to transmit a higher torque without damage.

Theoretically, with a given size of the rotor, the largest possible piston area is obtained by rectangular cross sections of piston and piston seat. However, a rectangular or virtually rectangular piston seat can be produced only with difficulty and involves the danger of notch stresses on the rotor. Therefore, according to further features of the invention, the two flat wall sections of a piston seat are preferably narrower than the diameter of a roller. The rollers are offset at both ends to form a collar of smaller diameter, whose diameter is at most as large as the width of a flat wall of a piston seat. This construction makes it possible to produce the contour of the piston seats with a milling tool and with a grinding tool, their diameter being greater than half the difference between the peripheral extent of a piston seat and the diameter of a roller. Such a milling tool is more stable and works more quickly than a tool of smaller diameter. In addition, a relatively large radius adjoining the flat wall sections limits the notch loading on the rotor. In particular, according to another feature of the invention, the width of a flat wall section of a piston seat amounts only to about sixty percent of the diameter of a roller.

According to still another feature of the invention, the collars at the ends of a roller are as short as possible, in order that the rollers have a large supporting area on the piston and a long support on the lifting ring.

According to yet another feature of the invention, each flat wall section of a piston seat is preferably adjoined by a curved wall section having a constant radius, which preferably extends at least approximately over ninety degrees. The radius of this wall section matches the radius of the tools with which the contour of the piston seats is produced, and may therefore be machined quickly.

If an inventive radial piston engine corresponding to DE 196 18 793 A1 has piston seats which each have a first part seat located entirely radially on the outside in the rotor and a second part seat of smaller cross section, which is located closer to the axis of rotation of the rotor than the first part seat and into which the pistons penetrate with a guide extension, then according to another feature of the invention, the cross section of the second part seat is advantageously circular.

According to still a further feature of the invention, the radius of a curved wall section of the first part seat, adjoining a flat wall section, and the radius of the second, circular part seat of a piston seat are in particular the same, so that the two part seats can be machined to a finish with the same milling and grinding tools.

BRIEF DESCRIPTION OF THE DRAWING

An exemplary embodiment of a hydraulic radial piston engine according to the invention is illustrated in the drawings. The invention will now be explained in more detail using the figures of these drawings, in which.

Figure 1:
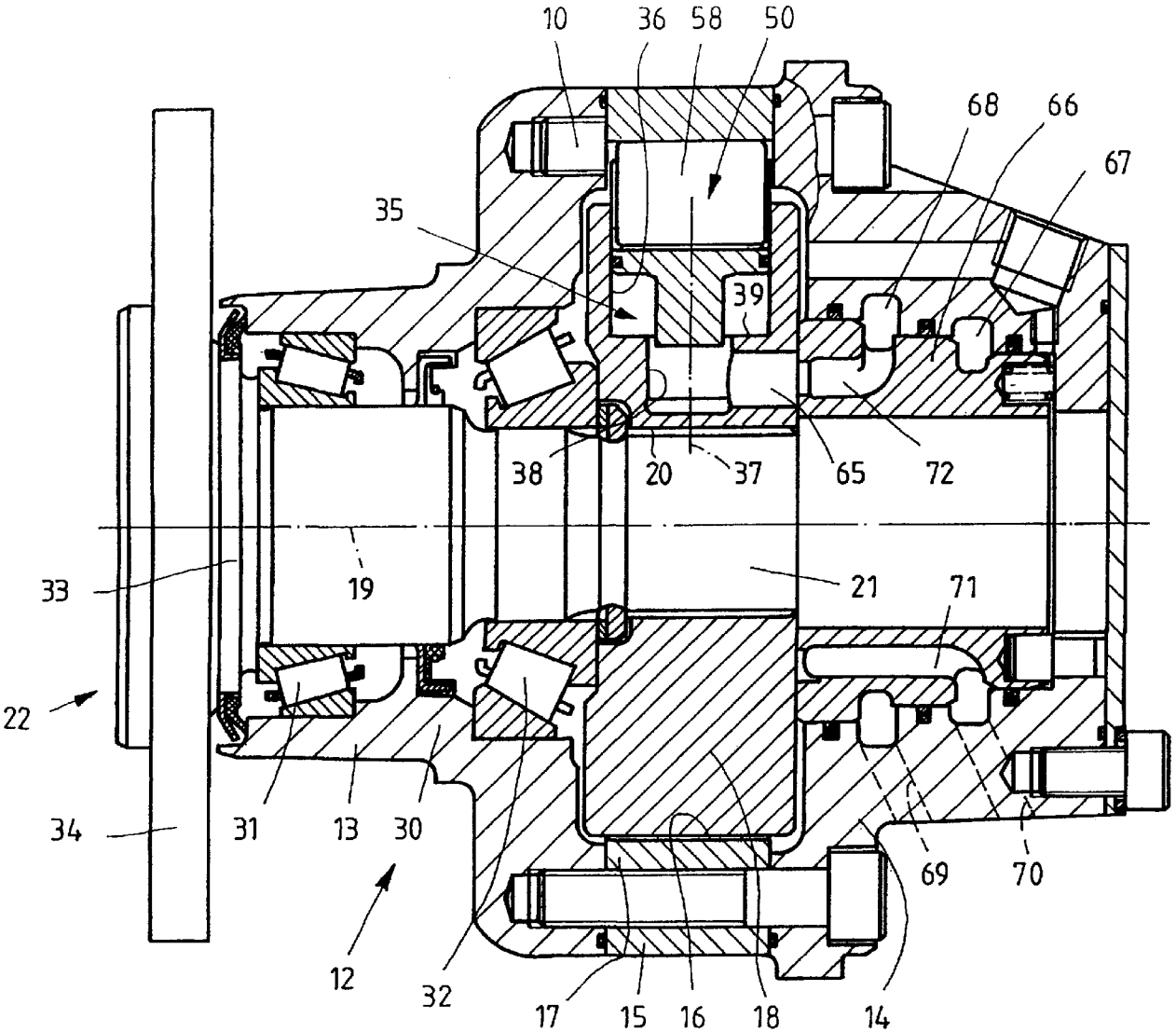
FIG. 1 shows the exemplary embodiment in a longitudinal section, the longitudinal section in the upper half lying in a first plane and that in the lower half lying in a second plane, and the visible radial piston being located at its outer dead point.
Figure 2:
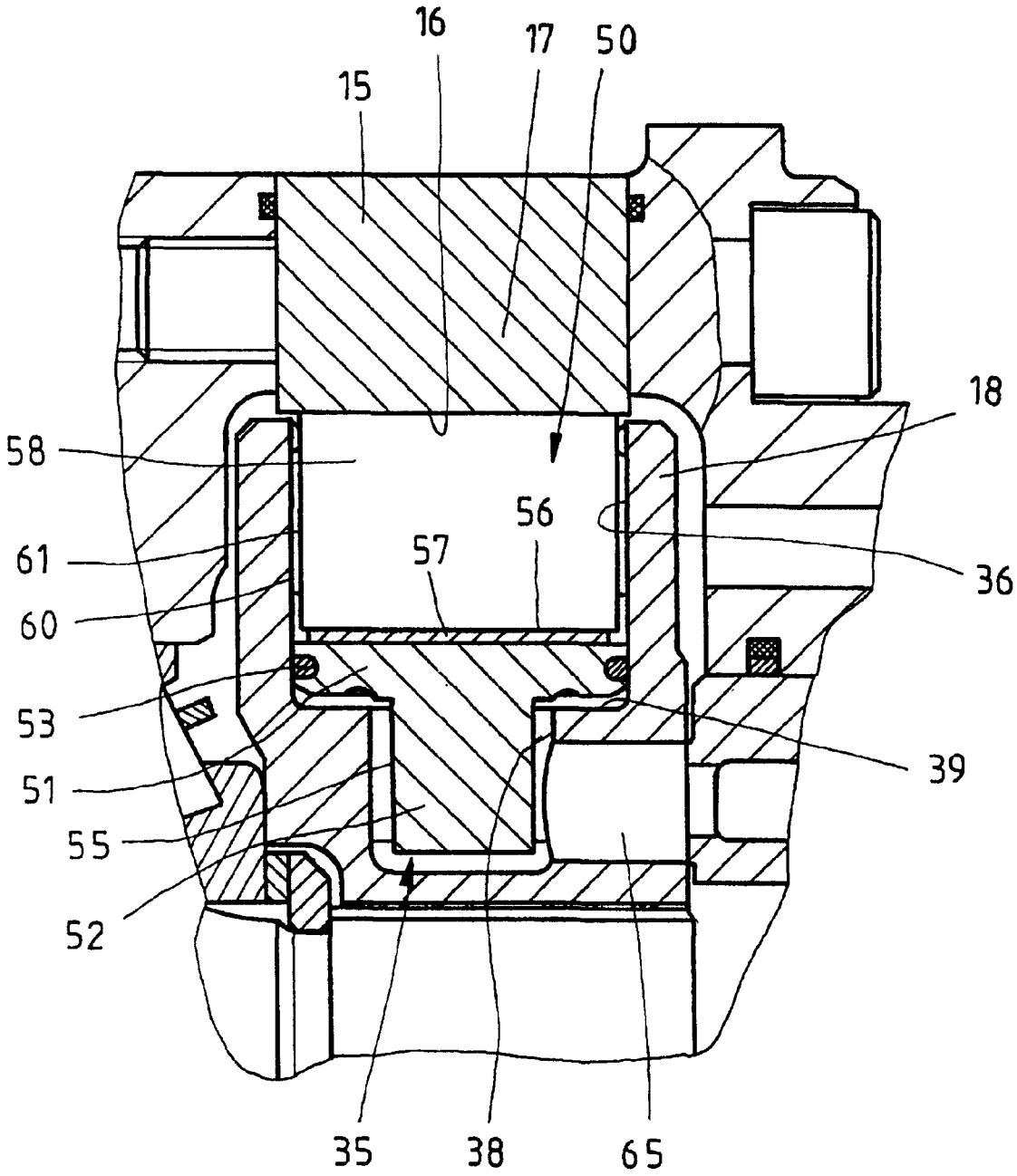
FIG. 2 shows a detail from FIG. 1 in the region of the visible radial piston, but which is now located at its inner dead point.

The radial piston engine shown wholly and partly in FIGS. 1 and 2 respectively is primarily used as a radial piston motor and has a casing 12 which is essentially assembled from two casing parts 13 and 14 and a lifting ring 15 arranged between these. The aforementioned three parts are held coaxially and fluid-tightly on one another by means of screws 10. The inner face of the lifting ring 15 is formed as a lifting cam 16, having a large number of inwardly protruding cams 17. Located within the lifting ring 15 is a rotor 18, which can be rotated about an axis of rotation 19 coinciding with the axis of the casing parts. The rotor 18 has a central passage 20 provided with inner toothing, in which an end section 21 of an output shaft 22, which is provided with external toothing corresponding to the internal toothing of the passage 20, is accommodated such that it can be displaced axially. The output shaft 22 is mounted via a bearing arrangement 30 such that it can be rotated with respect to the casing 12. In this case, the bearing arrangement comprises two conical roller bearings 31 and 32, which are accommodated in the casing part 13 and can transmit high axial and radial forces. The second end section 33 of the output shaft 22 protrudes from the casing part 13 and, outside the latter, has a shaft flange 34 for fixing to a drive element (not illustrated) of a device to be driven, for example to a wheel of a loader.

In the rotor 18, a large number of piston seats 35 that are aligned radially in a star shape with respect to the axis of rotation 19 and are open outward toward the lifting ring 15 are formed. Two part seats can be distinguished on a piston seat 35. A first part seat 36 is located on the outside of the rotor 18 and has a large cross section which differs from a circular shape and exhibits twofold symmetry with respect to a mid-axis 37, as emerges in more detail from FIG. 3. In this case, twofold symmetry means that the cross section overlaps itself again only after a rotation through 180 degrees about the mid-axis. The second part seat 38, which adjoins the part seat 36 on the inside, has a circularly cylindrical cross section, the diameter being substantially smaller than the extent of the first part seat 36 in the direction of the axis of rotation 19 and in the peripheral direction of the rotor 18. The axis of the part seat 38 coincides with the mid-axis 37, which can be designated the axis of the entire piston seat 35. The two part seats 36 and 38 merge into each other in an annular shoulder 39, which is at right angles to the mid-axis 37. The cross section of the first part seat 36 remains the same from the shoulder 39 out to the outside of the rotor 18.

Figure 3:
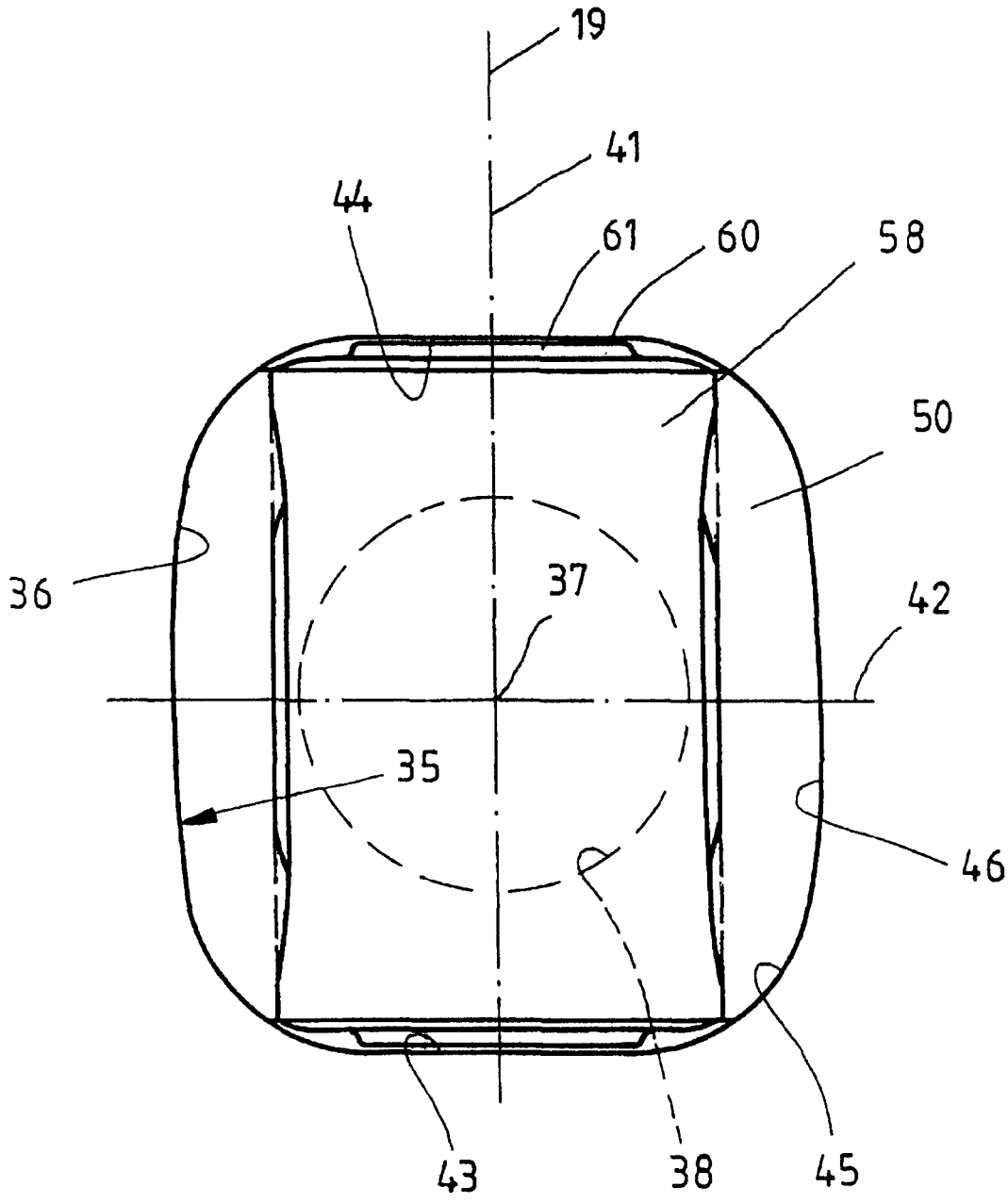
FIG. 3 shows a view radially from the outside of a piston seat and a radial piston located therein.
Figure 4:
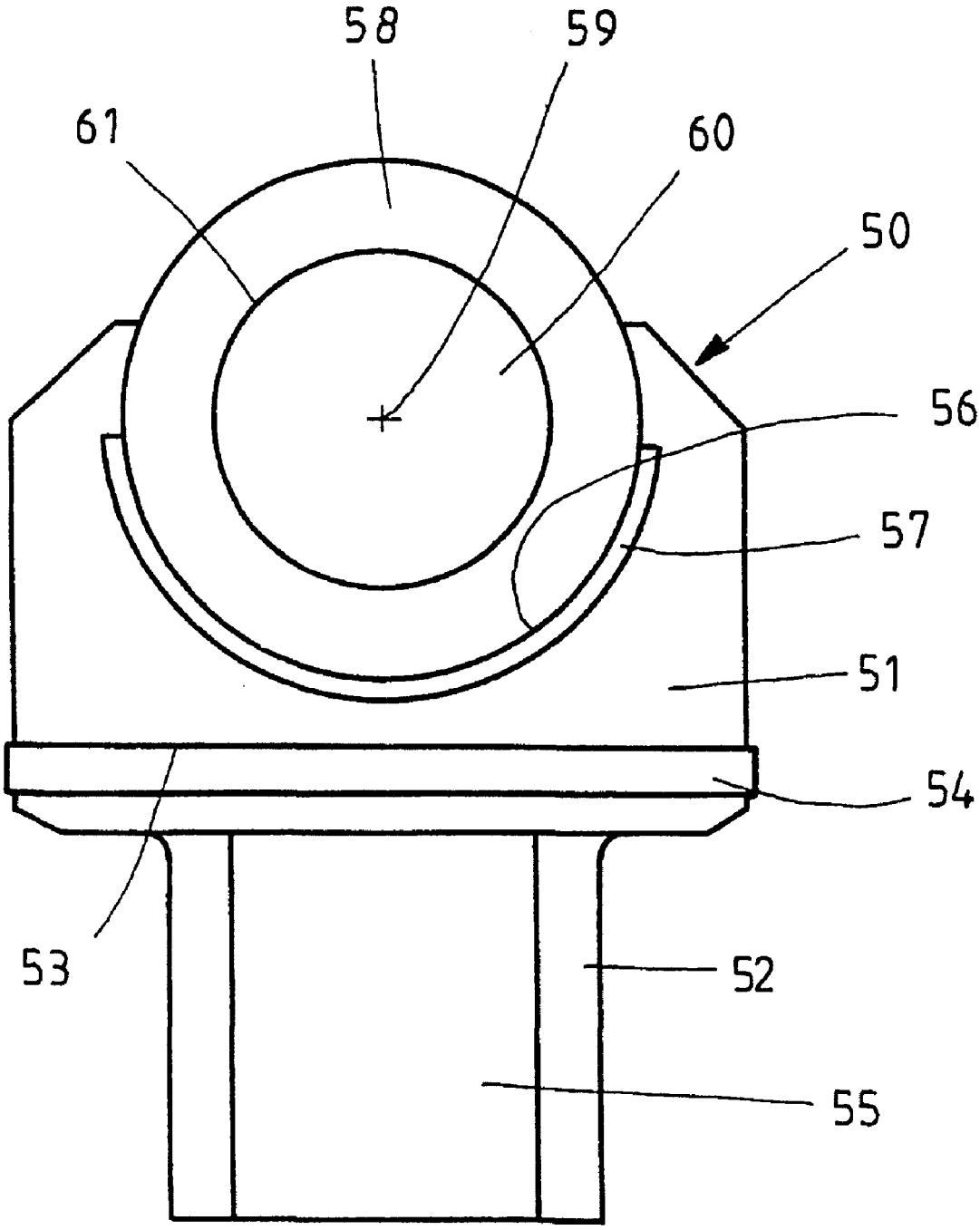
FIG. 4 shows a side view of the radial piston from FIG. 3 in the direction of the axis of rotation of the roller.

According to FIG. 3, the first part seat 36 of a piston seat 35 has a specific first maximum dimension in the direction of the axis of rotation 19 and a somewhat smaller second maximum dimension at right angles to a plane 41 spanned by the axis of rotation 19 and the mid-axis 37. It has two flat wall sections 43 and 44 which are opposite each other in the direction of the axis of rotation 19, that is to say are located parallel to a plane 42 at right angles to the axis of rotation 19, of which wall sections 43 and 44 each is located symmetrically on either side of the plane 41 and, at right angles to this plane 41, is somewhat less than half as wide as the maximum extent of the piston seat 35 in this direction. On each side, each flat wall section 43, 44 is adjoined by a wall section 45 which has a constant curvature, that is to say a constant radius, and extends over an angle of about 75 to 80 degrees. The radius is slightly larger than one quarter of the distance between the two flat wall sections 43 and 44. The transition between one end of a wall section 43, 44 and a wall section 45 is continuous in this case. The transition between the second end of a wall section 45 and a wall section 46 that adjoins the former and runs between the two second ends of two wall sections 45 is also continuous, the two wall sections 46, seen from the mid-axis 37, being curved slightly outward and being at the greatest distance from each other in the plane 42. Overall, therefore, the first part seat 36 of one piston seat 35 has a sharply rounded cross section similar to a rectangle. The second part seat 38 of a piston seat 35 has a circular cross section, and therefore has the shape of a circular cylinder. The radius of this circular cylinder is equal to the radius of the wall sections 45 of the first part seat 36, so that both part seats can be machine-finished with the same tools having the radius of the second part seat 38.

In each piston seat 35 there is a piston 50, on which, corresponding with the two part seats 36 and 38 of a piston seat 35, two piston sections 51 and 52 can be seen, which lie one behind another in the direction of the mid-axis 37 and can be distinguished from each other with regard to their circumferential outer surface. The first piston section 51 is guided such that it can be displaced in a sliding manner in the first part seat 36 of a piston seat 35 and, taking account of the play provided for its mobility, has the same cross section as the first part seat 36 of the piston seat 35. In the first piston section 51, a radially open groove 53 runs around in the vicinity of the lower end, in which groove there is a metallic sealing ring 54 which slides along on the wall of the first part seat 36. The second piston section 52 is formed as a double flat and has only a guide function. For its guide function, at least over a certain distance from its lower end and outside the two flats 55, it has a diameter which corresponds to the diameter of the second part seat 38 of a piston seat 35. The two flats 55 are at right angles on the axis of rotation 19 of the rotor. In the direction of the piston axis, which is the same as the mid-axis 37 of a piston seat, the second piston section 52 is so long that, in each stroke position of the piston 50, it still penetrates into the second part seat 38, so that the piston is always guided in the second part seat 38 as well as in the first part seat 36. The clearance which the piston leaves in the second part seat 38, and the clearance which the piston 50 leaves between itself and the shoulder 39 underneath the sealing ring 54 in the part seat 36, are connected fluidically openly to each other via the flats 55.

At a short distance radially outside the groove 53 and the sealing ring 54, the first piston section 51 is formed in the manner of a half-pipe, by means of which a continuous bearing seat 56 having a bearing shell 57 for a roller 58 is formed, said roller resting on the lifting ring 15. The axes 59 of the rollers run parallel to the axis of rotation 19 of the rotor 18. In the direction of its axis, a roller 58 is slightly shorter than the distance between the two flat wall sections 44 of a piston seat 35 and lies opposite each of these wall sections with a flat end face 60. The rollers 58 are therefore secured in their axial position in every lifting position of the pistons 50. The rollers are very long and therefore have a great line of contact or area of contact on the lifting cam 16. The two flat wall sections 44 are narrower, in a direction at right angles to the plane 41, than the diameter of a roller 58. Therefore, each end face 60 is formed on a collar 61, in which a roller 58 is offset at its end to a smaller diameter, corresponding approximately to the width of the flat wall sections 44. As can be seen from FIG. 3, the diameter of the collars 61 is so large that the end faces 60 and the flat wall sections 44 of the piston seats 35 are opposite each other even in the outermost lifting position of a piston 50 and secure the rollers 58 in the axial direction.

Owing to the non-circular cross sections of the piston seats 35 and the pistons 50, security against rotation about the mid-axis 37 is readily provided.

Each piston seat 35 is assigned an entry bore 65, which runs in the rotor 18 parallel to the axis of rotation 19 of the latter, starts from one end of the rotor, opens into the second part seat 38 and via which, during operation of the radial piston engine, hydraulic fluid is supplied and discharged. This is done via a commutator 66, which is arranged in a fluid-tight and rotationally fixed manner in the casing part 14. Between said commutator and the casing part 14 there are formed two annular chambers 67 and 68 which are separate from each other and which are connected to an inflow duct 69 and outflow duct 70 leading to the outside. From the end of the commutator 66 which faces the rotor 18, uniformly distributed, there originated a number of axial ducts 71 corresponding to the number of cams 17 on the lifting cam, said ducts opening into the annular chamber 67. Between two axial ducts 71 in each case, shorter axial ducts 72 which are connected to the annular chamber 68 run likewise from the aforesaid end of the commutator 66 and at the same distance from the axis of rotation 19 as the axial ducts 71. During operation, when a roller 58 runs onto a cam 17 of the lifting cam 16, hydraulic fluid is displaced from the working chamber of the corresponding piston seat 35, via the bore 65 in the rotor 18 and via one of the axial ducts 71 at zero pressure. In the region of the dome of a cam 17, the bore 65 comes out of overlap with the corresponding axial duct 71 and, shortly thereafter, comes into overlap with one of the shorter axial ducts 72. Hydraulic fluid is then supplied to the working chamber, so that the piston 50 is displaced outward and, as the roller 58 runs off a cam 17, a torque is produced.

The invention claimed is:

1. A hydraulic radial piston engine comprising:

a multi-stroke lifting ring (15) which is fixed to a casing, a rotor (18) which is mounted opposite the lifting ring (15) such that it is rotatable about an axis of rotation (19) and has multiple piston seats (35) aligned radially with respect to the axis of rotation (19), multiple pistons (50), of which in each case one is displaceably mounted in a piston seat (35) and which, over at least part of its length, has a guide and sealing cross section that differs from a circular shape and matches a guide and sealing cross section of the piston seats (35), which differs from a circular shape and remains constant as far as outside of the rotor, and cylindrical rollers (58) which are borne by the pistons (50) in bearing seats (56) and are aligned with their axes of rotation (59) in direction of axis of rotation of the rotor (18), via which the pistons (50) are supportable on the lifting ring (15) and which have two end faces (60) that face away from each other and run at right angles to their axis of rotation (59), wherein the piston seats (35) have two flat wall sections (44) aligned at right angles to the axis of rotation (59) of the rollers (58), and distance between the two end faces (60) of a roller (58) is only slightly smaller than distance between the two flat wall sections (44) of the piston seats (35).

2. The hydraulic radial piston engine as claimed in claim 1, wherein the two flat wall sections (44) of the piston seat (35) are narrower than the diameter of a roller (58), and wherein the roller (58) is offset at both ends to form a collar (61) of smaller diameter, whose diameter is at most as large as the width of a flat wall section (44) of the piston seat (35).

3. The hydraulic radial piston engine as claimed in claim 2, wherein the width of the flat wall section (44) of the piston seat (35) amounts to only about sixty percent of the diameter of the roller (58).

4. The hydraulic radial piston engine as claimed in claim 2, wherein extent of the collar (61) in direction of the axis (59) of the roller (58) amounts to about one-fortieth of the total length of the roller (58).

5. The hydraulic radial piston engine as claimed in claim 3, wherein extent of the collar (61) in direction of the axis (59) of the roller (58) amounts to about one-fortieth of the total length of the roller (58).

6. The hydraulic radial piston engine as claimed in claim 1, wherein both sides of each flat wall section (44) of the piston seat (35) are adjoined by a curved wall section (45) which has a constant radius.

7. The hydraulic radial piston engine as claimed in claim 6, wherein the curved wall section (45) extends approximately over ninety degrees.

8. The hydraulic radial piston engine as claimed in claim 1, wherein the piston seats (35) each have a first part seat (36) located radially entirely on the outside in the rotor (18) and having a cross section deviating from circular shape, and a second part seat (38) with a smaller cross section, which is located closer to the axis of rotation (19) of the rotor (18) than the first part seat (36), into which the pistons (50) penetrate with a guide extension (52) and whose cross section is circular.

9. The hydraulic radial piston engine as claimed in claim 1, wherein both sides of each flat wall section (44) of the piston seat (35) are adjoined by a curved wall section (45) which has a constant radius, and wherein the piston seats (35) each have a first part seat (36) located radially entirely on the outside in the rotor (18) and having a cross section deviating from circular shape, and a second part seat (38) with a smaller cross section, which is located closer to the axis of rotation (19) of the rotor (18) than the first part seat (36), into which the pistons (50) penetrate with a guide extension (52) and whose cross section is circular, and wherein the radius of a curved wall section (45) adjoining a flat wall section (44), and the radius of the second, circular part seat (38) of the piston seat (35) are equal.

* * * * *

UNITED STATES PATENT AND TRADEMARK OFFICE

CERTIFICATE OF CORRECTION

PATENT NO. : 7,028,600 B2
APPLICATION NO. : 10/344801
DATED : April 11, 2006
INVENTOR(S) : Mitsutoshi Higashi It is certified that error appears in the above-identified patent and that said Letters Patent is hereby corrected as shown below:

On the cover page, item (56), References Cited, Non-Patent Documents, insert --Kirt R. Williams, "Journal of Microelectromechanical Systems, Vol. 12, No. 6, December 2003, pages 771-778--

Column 1, line 8, change "particularty" to --particular--

Column 1, line 20, change "(in)" to --(In)--

Column 1, line 24, after "may" delete "be"

Column 2, line 41, change "a indium" to --an indium--

Column 6, line 11, change "In" to --in--

Column 8, line 2, after "comprising" delete ","

Column 8, line 5, after "having", insert --a--

Signed and Sealed this

Twenty-eighth Day of November, 2006

JON W. DUDAS
*Director of the United States Patent and Trademark Office*

UNITED STATES PATENT AND TRADEMARK OFFICE

CERTIFICATE OF CORRECTION

PATENT NO. : 7,028,600 B2
APPLICATION NO. : 10/344801
DATED : April 18, 2006
INVENTOR(S) : Chris Shrive et al.

It is certified that error appears in the above-identified patent and that said Letters Patent is hereby corrected as shown below:

This certificate supersedes Certificate of Correction issued November 28, 2006, should be vacated since no Certificate of Correction was granted for this patent number.

Signed and Sealed this

Second Day of January, 2007

JON W. DUDAS
*Director of the United States Patent and Trademark Office*